United States Patent [19]

Holmgren

[11] Patent Number: 4,863,079

[45] Date of Patent: Sep. 5, 1989

[54] DRAWSTRING RECOVERY AND RESTRINGING SYSTEM

[76] Inventor: Harry W. Holmgren, 1738 Tedbury, Crofton, Md. 21114

[21] Appl. No.: 160,951

[22] Filed: Feb. 26, 1988

[51] Int. Cl.[4] ..... D05B 85/00

[52] U.S. Cl. ..... 223/103

[58] Field of Search ..... 223/103, 102, 99, 104, 223/DIG. 4, 50; 66/1 A, 4; 24/131 R, 131 C; 128/339, 340; 289/16, 17; 294/3.6

[56] References Cited

U.S. PATENT DOCUMENTS

| | | | |
|---|---|---|---|
| 1,119,659 | 12/1914 | Steiner et al. | 223/103 |
| 1,730,415 | 10/1929 | Fischer | 223/103 |
| 1,751,796 | 3/1930 | Denner | 223/102 |
| 1,891,815 | 12/1932 | Heidrich et al. | 223/103 |
| 2,715,983 | 8/1955 | Fraser | 223/103 |
| 3,404,707 | 10/1968 | Feld | 223/99 X |
| 4,138,864 | 2/1979 | Bennett | 66/1 A |
| 4,671,437 | 6/1987 | Sauger | 223/103 |

FOREIGN PATENT DOCUMENTS

| | | | |
|---|---|---|---|
| 386973 | 7/1921 | Fed. Rep. of Germany | 223/99 |

*Primary Examiner*—Andrew M. Falik

*Attorney, Agent, or Firm*—Peter J. Georges

[57] ABSTRACT

A device for restringing and recovering a drawstring from a garment channel which is capable of use both in restringing and in recovering a drawstring from a garment channel. The device comprises a rod, one end of which is adapted to recover and retain a cord of the type typically used as a drawstring in garment channels. The cord retaining end utilizes a bite formed by a loop in the rod. The bite retains and allows for recovery of the drawstring.

4 Claims, 2 Drawing Sheets

ABA
1
2
3
21
22
23
25
27
27(a)
27(b)
28
29
31
32
40
50
α

DRAWSTRING RECOVERY AND RESTRINGING SYSTEM

BACKGROUND OF THE INVENTION

Drawstring restringing systems which facilitate restringing of a drawstring through a channel in garments such as sweatsuits are disclosed in a variety of prior U.S. patents, such as U.S. Pat. Nos. 299,305, issued May, 1884, 2,491,776, issued Dec. 20, 1949 and most recently, 4,671,437, issued June 9, 1987.

Referring to the drawstring restringing system disclosed in the most recent patent, it will be noted that the architecture requires the use of a two-piece system requiring retention of the drawstring at one end by means of an elastomeric bullet-shaped tip. Such a device, accordingly, is not suitable for both restringing and recovery of drawstring, the ends of which have been accidentally drawn into the clothing channel.

A simple, inexpensive one-piece drawstring recovery and restringing system has not heretofore been available.

SUMMARY OF THE INVENTION

The present invention relates to a device of simple structure which is capable of use both in restringing and in recovering a drawstring from a garment channel. The device comprises a rod, one end of which is adapted to recover and retain a cord of the type typically used as a drawstring in garment channels. The cord retaining end utilizes a bite formed by a loop in the rod. The bite retains and allows for recovery of the drawstring. The rod preferably is of round cross-section, though other configurations may be used, provided that the size of the rod is such that the looped end can be inserted through the opening of the garment channel and then can be rotated without tearing the channel.

Optionally the rod end opposite the end with the loop arrangement may be flattened, doubled back or otherwise shaped to facilitate handling of the rod at the end of the rod opposite the drawstring engaging/retaining end.

DETAILED DESCRIPTION OF THE INVENTION

Figures 1, 2, 3, 4, 5, 6, 7, 8:
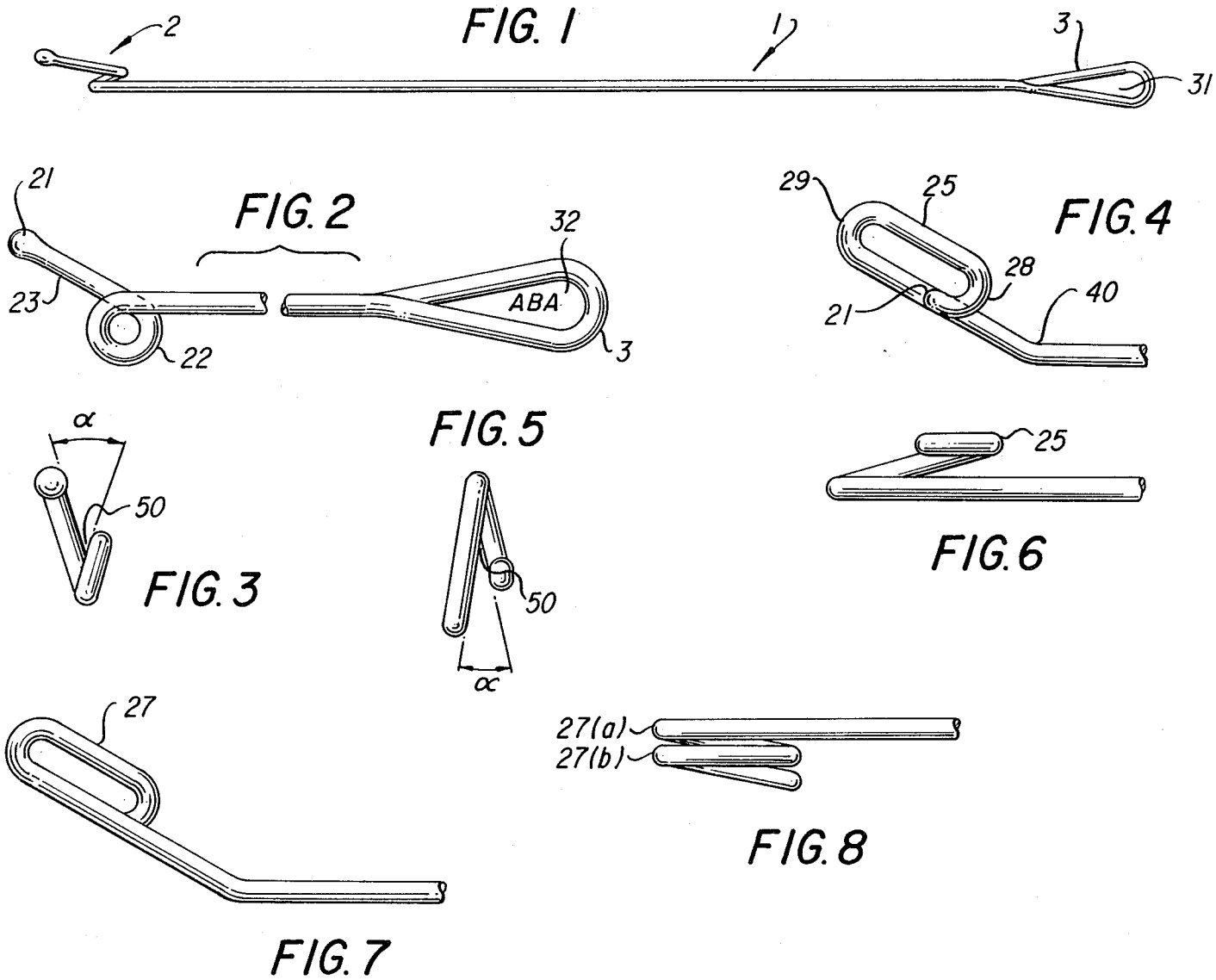
FIG. 1 is a top plan view of a first embodiment of the invention.
FIG. 2 is a broken side elevational view of the first embodiment of a drawstring engaging looped end at the left-hand side of the drawing.
FIG. 3 is a front elevational view of the first embodiment.
FIG. 4 is a partial side elevational view of a second embodiment of a drawstring engaging looped end.
FIG. 5 is a front elevational view of a second embodiment of the invention.
FIG. 6 is a partial bottom plan view of the second embodiment.
FIG. 7 is a partial side elevational view of a third embodiment of a drawstring engaging looped end at the left-hand side of the drawstring.
FIG. 8 is a partial bottom plan view of a third embodiment of the invention.

The drawstring-engaging device of the invention is referred to generally in FIG. 1 by reference to numeral 1 and includes a drawstring engaging end referred to generally by numeral 2 and opposite thereto, a handling facilitating end referred to by numeral 3. The drawstring-engaging device of the invention illustrated in FIG. 1 is formed from a single rod, suitably of metal, plastic or some other rigid material that can be fabricated to correspond to the desired configuration. The drawstringengaging end 2 must be of a size that permits insertion into the drawstring channel opening of a garment. The handling facilitating end 3 is also sized to permit insertion into the drawstring channel opening of the garment. Where the rod is intended only for recovery of a drawstring rather than for inserting/reinserting the drawstring through the channel, the size of handling facilitating end 3 need not be small enough to pass through a drawstring channel opening.

Figure 9:
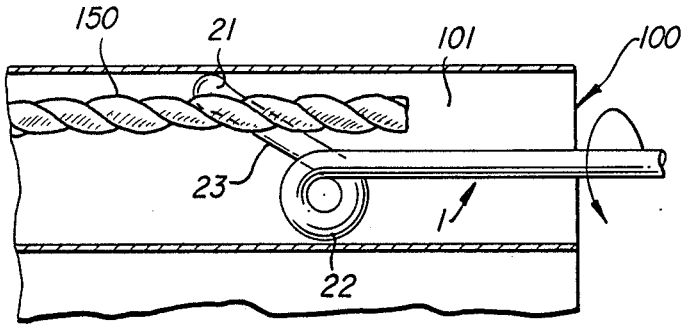
FIG. 9 shows the first step in the use of the first embodiment in engaging the drawstring by the looped end.

As seen in FIG. 2, at the drawstring-engaging end the rod end 21 is rounded and smoothed. This shape and finish are preferable in order not to snag the material which forms the interior wall of the garment channel. By reference to FIG. 2, it is noted that intermediate (1) loop 22, which forms a bite for drawstring engagement and retention, and (2) rounded rod end 21, rod portion 23 forms a means, when the rod is rotated as shown in FIG. 9, of expanding/sweeping the inside of the drawstring channel.

As also shown in FIG. 2, the rod is bent in such manner as to form bite-forming loop 22 defined by crossed rod portions and a substantially straight rod portion 23 extending beyond the loop and at an angle to the rod portion situated before the bite-forming loop 22.

The handling facilitating end shown in FIG. 2 can be formed by bending the rod back on itself. Within the opening 31 (see FIG. 1) formed in this manner, a logo and/or message inscribed sheet 32 can be fitted as shown in FIG. 2. The sheet, which suitably conforms to the opening may be attached along the edges thereof where contact is made with the rod describing the opening. A surface for inscribing a message can also be made by flattening the rod at the handling facilitating end as well as by affixing a suitable logo or message-carrying sheet on or at the handling facilitating end. The sheet can be of any shape where it is affixed on the rod rather than within an opening formed by the rod.

As shown in FIG. 4, the loop can have a racetrack configuration with the rod end 21 not extending beyond racetrack loop 25 formed by U-shaped bends 28 and 29. As also shown in FIG. 4, there is a bend in the rod situated before loop 25. This arrangement facilitates insertion into garment channels which generally have rather small openings, which are sometimes inflexible.

As best shown in FIGS. 3 and 5, the bite 50 is formed by loops 22 and 25, respectively. Angle $\alpha$ defines the angle of the bite which, though dependent on the drawstring size and other drawstring material characteristics, suitably is an angle of about $13.5° \pm 10\%$.

Illustrated in FIGS. 7 and 8 is a double loop 27 which illustrates the double loop bite-forming embodiment of the invention with loops 27(*a*) and 27(*b*) of double loop 27 shown in FIG. 8.

Figure 10:
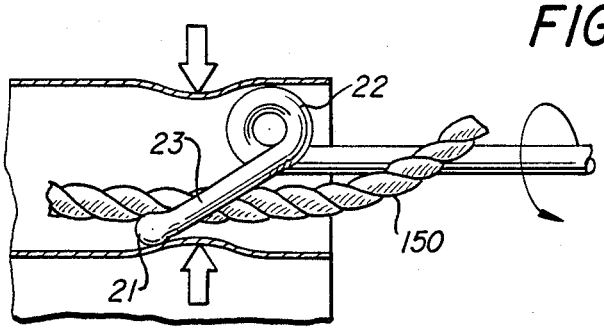
FIG. 10 shows the second step in the use of the first embodiment in engaging the drawstring by the looped end.
Figure 11:
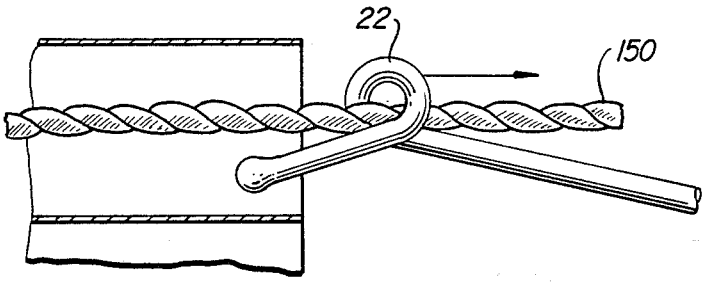
FIG. 11 shows the final step of engagement, illustrating the drawstring engaged by the loop-formed bite and in the process of withdrawal from a drawstring garment channel.

FIGS. 9 to 11 inclusive, illustrate how to use the drawstring engaging device of the present invention.

As shown in FIG. 9, the rod is first inserted in garment channel 100; bite-forming loop 22 is introduced far enough into the channel 100 so as to engage drawstring 150, as shown in FIG. 9 where the bite-forming loop is shown beneath drawstring 150. The rod is rotated as shown in FIG. 9. Rod end 21 sweeps the inside of the channel as the rod is rotated; in other words, the rotation causes the rod end to touch the interior 101 of the garment channel along the entire circumference of the interior wall of the channel which ordinarily is collapsed. The drawstring 150 is thus initially engaged by rod portion 23 during rotation.

As represented in FIG. 10, at the same time that the rod is being rotated, the wall of the garment channel above the bite is collapsed, to force the drawstring into the bite. Engagement may be effected in this manner simply by squeezing the channel by hand during rotation.

As represented in FIG. 11, after the drawstring is pressed into and engaged by the bite formed by loop 22, rod movement in the direction indicated in FIG. 11 can be used to move and recover drawstring 150.

It will be further seen that minor changes may be made in the form, shape and material of my device without however departing from the scope and spirit of my invention.

I claim:

1. A drawstring engaging device suitable for recovering a drawstring from or introducing a drawstring into a garment channel, said drawstring channel engaging device comprising a rod comprised of a handling facilitating end, a drawstring expanding end and intermediate said handling facilitating end and drawstring channel expanding end, a loop defined by crossed rod portions forming a bite for engaging and retaining the drawstring, said drawstring channel expanding end comprising a substantially straight portion of rod extending at an angle to that portion of the rod comprising the handling facilitating end, said drawstring channel expanding end being further characterized by a rounded and smoothed rod end to prevent snagging of said rod end within the garment channel when the drawstring expanding end is inserted into the garment channel.

2. The drawstring-engaging device of claim 1, wherein the bite defines an angle of about 13.5°±10%.

3. A drawstring-engaging device, suitable for recovering a drawstring from or introducing a drawstring into a garment channel, comprising a rod having a drawstring-engaging end and a handling facilitating end, said drawstring-engaging end comprising (1) a first U-shaped bend in said rod, said U-shaped bend forming the terminus of the drawstring-engaging device that is inserted into the garment channel and a bite for engaging and retaining the drawstring, (2) a rounded and smoothed rod end to prevent snagging of said rod end within the garment channel, and (3) a second Ushaped bend in said rod between the rod end and the first U-shaped bend; said rod, intermediate said drawstring-engaging end and said handling facilitating end having a bend therein, proximate the drawstring engaging end for expanding the drawstring channel.

4. The drawstring-engaging device of claim 3, wherein the bite defines an angle of about 13.5°±10%.

* * * * *